US007757319B2

(12) United States Patent
Kimball

(10) Patent No.: US 7,757,319 B2
(45) Date of Patent: Jul. 20, 2010

(54) WOUND ELEVATION PROTECTION AND PREVENTION DEVICE

(76) Inventor: Helen R. Kimball, 3946 NW. 22nd St., Coconut Creek, FL (US) 33066-2029

( * ) Notice: Subject to any disclaimer, the term of this patent is extended or adjusted under 35 U.S.C. 154(b) by 80 days.

(21) Appl. No.: 11/230,108

(22) Filed: Sep. 19, 2005

(65) Prior Publication Data

US 2007/0061973 A1 Mar. 22, 2007

(51) Int. Cl.
*A47G 9/00* (2006.01)

(52) U.S. Cl. ..... 5/632; 5/953; 5/640; 5/648

(58) Field of Classification Search ..... 5/632, 5/630, 646, 648
See application file for complete search history.

(56) References Cited

U.S. PATENT DOCUMENTS

| | | | | |
|---|---|---|---|---|
| 3,299,451 | A * | 1/1967 | Trogdon | 5/640 |
| 3,811,140 | A * | 5/1974 | Burpo | 5/632 |
| 4,425,676 | A | 1/1984 | Crane | |
| 4,614,000 | A | 9/1986 | Mayer | |
| 4,779,297 | A | 10/1988 | Sturges | |
| 4,959,059 | A | 9/1990 | Eilender et al. | |
| 4,962,769 | A | 10/1990 | Garcia | |
| 5,085,214 | A * | 2/1992 | Barrett | 5/648 |
| 5,148,564 | A * | 9/1992 | Reder | 5/636 |
| 5,462,519 | A | 10/1995 | Carver | |
| 5,511,260 | A | 4/1996 | Dinsmoor, III et al. | |
| 5,615,432 | A | 4/1997 | Von Ohlen, III | |
| 5,618,263 | A * | 4/1997 | Alivizatos | 602/6 |
| 5,638,564 | A | 6/1997 | Greenawalt et al. | |
| 6,009,577 | A | 1/2000 | Day | |
| 6,196,156 | B1 * | 3/2001 | Denesuk et al. | 119/28.5 |
| 6,578,218 | B2 * | 6/2003 | Wassilefsky | 5/648 |
| 6,595,935 | B2 | 7/2003 | Gerstmar | |
| 6,795,990 | B1 * | 9/2004 | Hutchinson | 5/632 |
| 6,918,148 | B2 * | 7/2005 | Auxila | 5/655 |
| 2003/0163072 | A1 | 8/2003 | Hueso | |

OTHER PUBLICATIONS

Ehob Home Care Products http://www.ehob.com/consumers/products/products.php?rnode=category&cat_ id=3.

* cited by examiner

*Primary Examiner*—Fredrick Conley
(74) *Attorney, Agent, or Firm*—Jacqueline Tadros; Jacqueline Tadros, P.A.

(57) ABSTRACT

The present invention is a wound elevation device for alleviating or diminishing pressure on a wound, blemish, decubitus ulcer (also known as pressure ulcer or pressure sore) or surgical site by elevating the affected area above a surface and surrounding the wound without directly contacting or covering the wound, for allowing increased air and blood flow to the wound. An interior filling of the present invention is composed of a Visco/Memory foam, natural buckwheat hulls, whole buckwheat seeds, millet hulls, or a combination thereof, or other suitable material known in the art. The interior filling is enclosed in a unitary, elongated, flexible hollow member, and an additional removable and/or reusable cover composed of anti-bacterial/anti-microbial fabric encloses the hollow member for additional protection. Fastening means allow the user to reconfigure the shape of the device to provide the required support for each use.

8 Claims, 3 Drawing Sheets

WOUND ELEVATION PROTECTION AND PREVENTION DEVICE

BACKGROUND OF THE INVENTION

1. Field of the Invention

This invention relates generally to the treatment and prevention of wounds, and more particularly to a device for alleviating or diminishing pressure on a wound, blemish, decubitus ulcer (also known as pressure ulcer or pressure sore) or surgical site.

2. Discussion of Related Art

Pressure sores are a localized area of damaged tissue. Pressure sores occur when soft tissue between a bony prominence and an external surface is compressed for an extended amount of time. Pressure sores, also known as bed sores or decubitus ulcers is usually occur from confinement to a bed, chair or wheelchair. In many instances, pressure sores are a secondary result of another illness or condition that leaves a person immobile.

Patients who are immobile tend to lie in one position for hours on end. This causes a decrease in blood circulation to certain pressure points on the body known as "bony prominences", such as, for example, ears, shoulders, hips, coccyx (tail bone), buttocks, elbows, ankles and heels, to name a few. These areas are typically the first to break down. The tissue closest to the bone is the most susceptible to pressure sores so a visible skin discoloration may indicate the beginning stages of a pressure sore. The tissue begins to decay from lack of blood circulation. This is the basic formation of decubitus ulcer development.

The prevalence of pressure sores in the United States alone is estimated to be between 1.5 to 3.0 million people. Every year an estimated 60,000 people die from a bedsore complication.

Pressure sores will appear as a red area that can develop into an open wound if left without medical treatment. If pressure sores are left untreated, they can lead to severe health complications and even death.

A decubitus ulcer or pressure sore can range from a very mild pink coloration of the skin, which disappears in a few hours after pressure is relieved on the area, to a very deep wound extending to and sometimes through a bone into an internal organ. These ulcers, as well as other wound types, are classified in stages according to the severity of the wound.

The usual mechanism of forming a decubitus ulcer is from pressure. However, it can also occur from friction, such as by rubbing against a bed sheet, cast, brace, or the like.

The pressure sore and the affected area must be kept clean and clear of any dead tissue. Because pressure sores can expose a patient to infection entering the blood stream, a potentially deadly condition called sepsis, medical care is a very necessary and worthwhile precaution. It has been reported in fact, that sepsis is the $11^{th}$ leading cause of death, overall. Wound care is a tremendous drain on the national health care system.

The goal in the treatment of pressure sores is to relieve the pressure on and around bony prominences. This can be accomplished by increasing air flow and blood flow to the affected area so that pressure sores do not continue to worsen. Frequent turning is mandatory to alleviate pressure on the wound and to promote healing. Support devices can help relieve some of the pressure on the pressure sores. Wound care products comprise devices for open wound support, such as medicated dressings, wraps, protectors, mattress pads and cushions.

Although these devices and treatments are helpful, they remain ineffective in many respects. Dressings and wraps, for example, are in direct physical contact with the wound surface. Consequently, these devices apply pressure on the wound area. This pressure results in a longer healing time and the affected areas are therefore more prone to the formation of decubitus ulcers.

Mattress pads and cushions also have considerable drawbacks. The mattress pads and cushions available today have a definite geometrical shape and size which cannot be easily altered to adapt to individual needs.

Wound protectors are typically used during the transportation of accident victims. These protectors often cannot be applied to bed sores or some surgical sites because of their limited design.

Thus, there is clear and distinct need for a device which will effectively alleviate or diminish pressure on a wound by elevating the affected area, 0.25 inches to 3.0 inches above a surface while also avoiding direct physical contact with the wound, blemish, pressure ulcer or surgical site.

It is known in the art to use a cushioning means for the purpose of elevating the body and increasing air flow to pressure points, thereby reducing the incidence of pressure or decubitus ulcers.

For example, U.S. Pat. No. 5,511,260 naming as inventor, Dinsmoor III et al. and U.S. Pat. No. 4,614,000 naming as inventor Mayer, U.S. Pat. No. 4,959,059 naming as inventor Eilender, U.S. Pat. No. 4,962,769 naming as inventor Garcia, U.S. Pat. No. 5,462,519 naming as inventor Carver and U.S. Pat. No. 4,425,676 naming as inventor Crane, teach a mattress replacement or treatment overlay for the purpose of elevating the body and increasing air flow to certain pressure points, thereby reducing the incidence of pressure or decubitus ulcers.

These cushioning means, however, are large and bulky and cannot be easily manipulated to alter their shape or size to accommodate to individual needs.

U.S. Pat. No. 4,779,297 naming as inventor, Sturges, teaches that it is known in the art to have a compact cushion support article for the purpose of elevating the body, increasing air flow to pressure points, and thereby reducing the incidence of pressure or decubitus ulcers.

These devices however, have a definite geometric shape and size, for example a "donut" shape. This shape cannot be altered and hence its usefulness is limited. Similarly, the "Waffle Extended Care Cushion" from EHOB, Inc., although compact, cannot be manipulated with ease to adopt a different shape or size.

U.S. Patent Application No. 20030163072 naming as inventor, Cristian Hueso teaches a conic arch device that provides physical protection to any superficial wound. However, as with the "donut" and "waffle" shaped cushions, the shape of this device is not capable of being easily altered and cannot be adapted to accommodate individualized needs.

U.S. Pat. No. 6,009,577 naming as inventor, Day, U.S. Pat. No. 5,638,564, naming as inventor Greenwalt, U.S. Pat. No. 5,615,432 naming as inventor Van Ohlen III and U.S. Pat. No. 6,595,935 naming as inventor Gerstmar teach that it is known in the art to have a crescent or U-shaped type pillow as a cushioning means for the head and neck. These devices, however, have not been adapted for the treatment or prevention of pressure sores, decubitus ulcers, etc. and their usefulness in that respect is limited.

Thus, there is a definite, distinct, and even urgent need for a device in the treatment of decubitus ulcers, wounds, blemishes, etc. which will alleviate pressure by elevating the body 0.25 to 3.0 inches above a surface, without covering the wound, blemish, pressure ulcer or surgical site and which is capable of easily being manipulated to conform to individualized needs.

The present invention accomplishes these objectives and substantially departs from the conventional concepts and designs of the prior art.

SUMMARY OF THE INVENTION

The present invention solves the foregoing problems by providing a device which is placed around and not on the pressure point, thus elevating the bony prominence without covering the wound, and thus eliminating pressure to the affected area.

In view of the foregoing disadvantages inherent in the treatments of wound care currently available, the present invention provides a novel device for alleviating or diminishing pressure on a wound surface by elevating the affected area 0.25 to 3.0 inches above a surface, while simultaneously avoiding direct contact with or covering the wound, blemish, pressure ulcer or surgical site to allow increased air flow to the site.

The general purpose of the present invention, which will subsequently be described in further detail, is to provide a device for alleviating pressure from surface wounds.

Eliminating pressure with a device which also simultaneously avoids covering the wound, allows increased air flow and blood circulation to the critical areas which alleviates and ideally prevents the occurrence of decubitus ulcers.

An object of the present invention is to provide a device for alleviating pressure from surface wounds which overcomes the shortcomings of the prior art in wound treatment.

One aspect of the present invention is designed to keep the critical pressure points 0.25 to 3.0 inches above a surface, such as bedding, etc.

Another aspect of the present invention is that it is convenient, adjustable, malleable, portable, transportable and easy to use. It may thus be manipulated with greater ease and frequency, in order to promote healing.

A feature of the present invention is that it is designed to surround the critical area without covering the wound.

Another feature of the present invention is to provide a device for alleviating or diminishing pressure from surface wounds by elevating the critical area of the body above a surface, yet not covering or directly contacting the wound, blemish, pressure ulcer or surgical site.

Memory foam is used in the medical industry to relieve pressure sores. Memory foam responds well to temperature and has the ability to spread pressure over a relatively large surface area, thereby reducing pressure points significantly.

Memory foam cells compress fully and spread their air to adjoining cells. This accounts for the way that memory foam actually reduces pressure points. This also allows it to conform to a body's shape, providing a custom shaping type effect.

In addition, memory foam is temperature sensitive. This serves to accentuate the custom molding affect of the foam. Memory foam is known as a visco-elastic foam that is, it is harder (more viscous) at lower temperatures and softer and bouncier (more elastic) at higher temperatures.

A feature of the present invention is that it is a device which generally comprises a Visco/Memory foam shaped in the form of a circle, square or other cross-section, covered by a protective sheath.

Buckwheat hulls are lightweight, durable and have a comfortable cooling effect. The hulls flow easily to adapt to the contours of a body, providing a gentle yet firm and passive support. Millet hulls are dense and soft, and also conform to the body contours.

Another feature of the present invention is that it is a device which generally comprises buckwheat hulls, buckwheat seeds, millet hulls, or a combination thereof, in the form of a circle, square or other cross-section and covered by a protective sheath.

Another aspect of the present invention is an additional removable cover, made of anti-bacterial/anti-microbial fabric as is commonly known in the art. This removable cover is placed over the protective sheath and can be washed, sterilized and re-used.

A feature of the present invention is the use of tie strips, Velcro hook-and-loop fastner ("Velcro") strips or other fastening means known in the art. The tie strips, Velcro strips or other fastening means are attached to the external cover to adjust the shape of the device in order to accommodate individualized and specific needs.

Another object of the present invention is to provide a device for alleviating pressure from a wound by elevating the affected area above a surface, such as a bedding, thereby eliminating direct contact between the wound and the surface, thus diminishing pressure on the wound Another object of the present invention is to provide a device for alleviating pressure from surface wounds whose geometric shape and size can be altered with ease in order to accommodate different wound sites.

Another object is to provide a device for alleviating pressure from surface wounds and composed of a Visco/Memory foam which conforms to a body and as a result is comfortable and more effective.

Another object is to provide a device for alleviating pressure from surface wounds and composed of a Buckwheat hulls, Millet hulls, or a combination thereof which conforms to a body and as a result is comfortable and more effective.

Another object is to provide a device for alleviating pressure from surface wounds and composed of a Visco/Memory foam, Buckwheat hulls, Whole Buckwheat seeds, Millet hulls, or a combination thereof, or other material known in the art, which conforms to a body.

Another object is to provide a device for alleviating pressure from surface wounds wherein the device is light in weight and easy to handle.

The present invention as described herein incorporates advantages of other wound care treatments mentioned herewith, as well as other novel features, resulting in a device for alleviating pressure from a surface wound which is new, not anticipated, rendered obvious, suggested or implied by any of the prior art, either alone or in any combination thereof.

Other objects and advantages of the present invention will become obvious to the reader and it is intended that these objects and advantages are within the scope of the present invention There has thus been outlined, rather broadly, the more important features of the invention in order that the detailed description thereof may be better understood, and in order that the present contribution to the art may be better appreciated. Other features and advantages of the present invention will become apparent from the following more detailed description, taken in conjunction with the accompanying drawings, which illustrate, by way of example, the principles of the invention.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of the description and should not be regarded as limiting.

DESCRIPTION OF THE DRAWINGS

FIG. 2A' is a cross-sectional view of an alternate embodiment of the invention, taken generally along lines 2A-2A of FIG. 1A, denoting an alternate filling material such as one composed of buckwheat hulls, whole buckwheat seeds, millet hulls or any combination thereof;

FIG. 2B' is a cross-sectional view of the alternate embodiment of the invention, taken generally along lines 2B-2B of FIG. 1B, denoting the alternate filling material, such as one composed of buckwheat hulls, whole buckwheat seeds, millet hulls or any combination thereof;

DETAILED DESCRIPTION OF THE PREFERRED EMBODIMENT

Referring to FIGS. 1A-6B, a device for alleviating or diminishing pressure from wounds according to an embodiment of the present invention is identified generally at reference number 1.

Figure 1A:
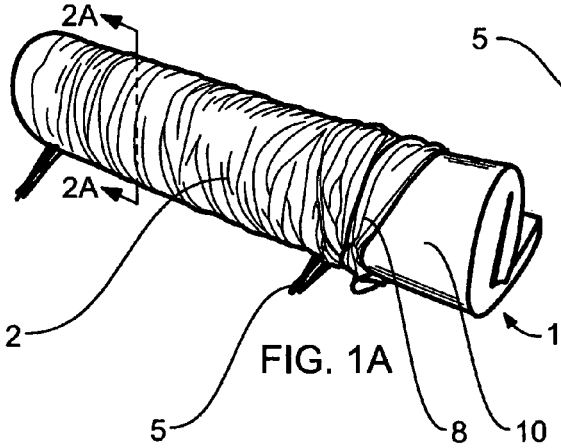
FIG. 1A is a perspective view of an embodiment of the invention having a generally circular cross section cushion, the cushion shown partially removed from a protective hollow member 8.
Figure 1B:
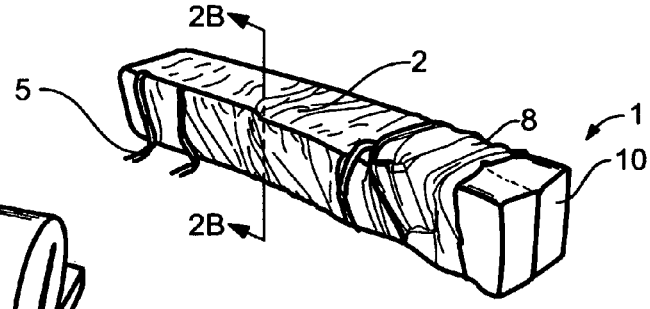
FIG. 1B is a perspective view of an embodiment of the invention having a generally square cross section cushion, the cushion shown partially removed from the protective hollow member 8.

A filling material such as a viscoelastic polyurethane foam 10, or other suitable material known in the art, is shaped in the general form of a circle as in FIG. 1A, or a square, as in FIG. 1B, or any other suitable cross-section shape. An acid free multi purpose spray adhesive, such as Elmer's Craft Bond (not shown), or other adhesive material commonly known in the art, is used to maintain the shape of the viscoelastic polyurethane foam 10. The adhesive is applied to the viscoelastic polyurethane foam 10 prior to shaping the foam 10. Once the foam 10 is molded to the desired shape, it is allowed to set for a suitable duration of time to allow the adhesive to cure.

FIGS. 1A and 1B show the viscoelastic polyurethane foam 10, encased in a unitary, flexible, hollow member 8. The hollow member is composed of plastic film or other sheet material or other suitable material known in the art. As normally used, the hollow member 8 fully encloses the foam 10, but may include either an open end (as illustrated) or a longitudinal opening, such opening closable by a closure means such as a zipper, or the like (not shown). As noted, the filling material may be of varying cross-section shapes and lengths. As shown, the hollow member 8 has a substantially uniform cross-section when filled with the foam. The hollow member 8 is preferably covered with a removable protective sheath or casing 2 composed of anti-bacterial/anti-microbial fabric as is known in the art, is used to protect the hollow member 8 and keep said hollow member 8 from getting soiled.

Tie strips 12, Velcro strips 13, identified generally at reference number 5, or other fastening means known in the art are attached to the removable protective sheath or casing 2. Tie strips 12, Velcro strips 13 or other fastening means known in the art are used to adjust the geometrical shape and size of the Visco/Memory foam 10 as shown in FIG. 3 to provide the requisite support.

Figure 2A:
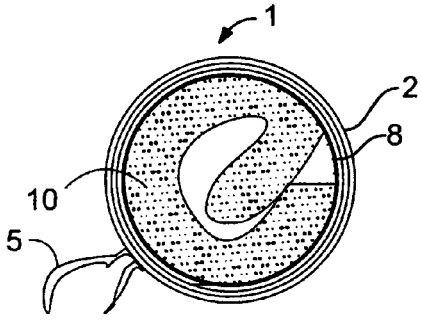
FIG. 2A is a cross-sectional view of the invention, taken generally along lines 2A-2A of FIG. 1A.
Figure 2B:
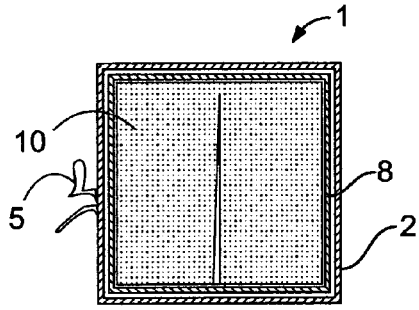
FIG. 2B is a cross-sectional view of the invention, taken generally along lines 2B-2B of FIG. 1B.
Figure 2A:
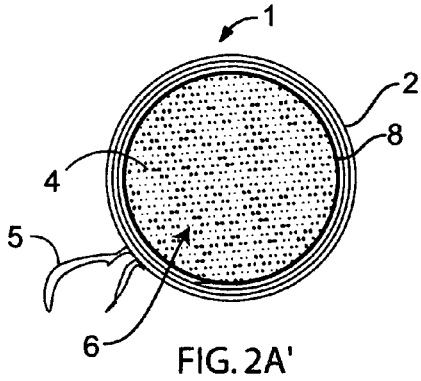
Figure 2B:
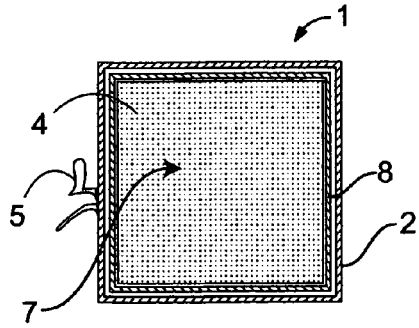

FIGS. 2A' and 2B' show cross-sectional views across longitudinal axes of a circular cross-section shape of foam 10 and a square cross-section shape of foam 10, respectively, with an alternate filling material such as buckwheat hulls, whole buckwheat seeds, millet hulls or any combination thereof. The density and composition of the filling may vary to accommodate specific needs.

Figure 3:
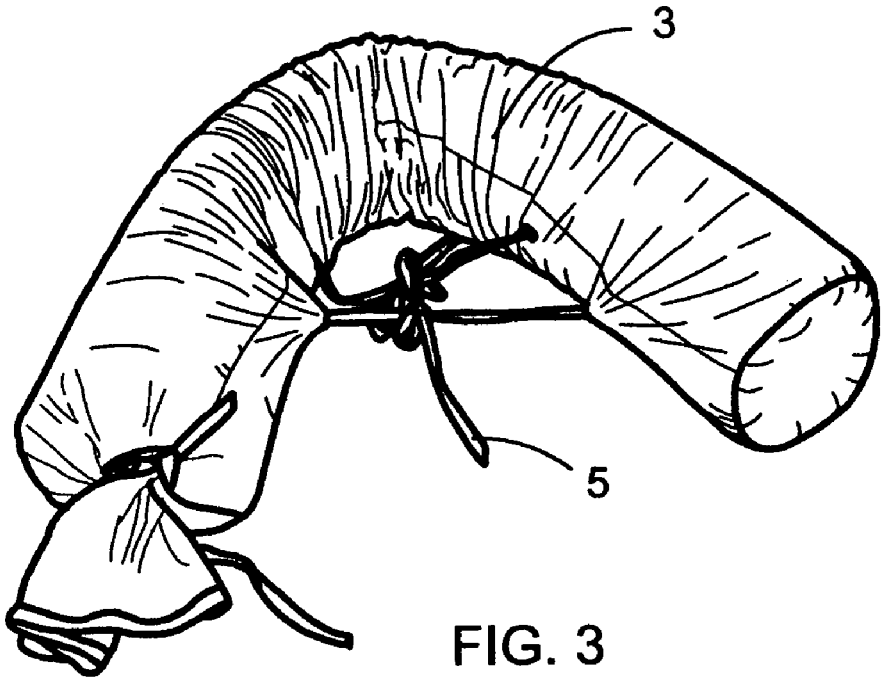
FIG. 3 is a perspective view of the embodiment of the invention having a circular cross shape cushion manipulated so as to form a U-shape.

FIG. 3 shows a perspective view of the embodiment of the invention having foam 10 with the circular cross-section cushion illustrated in FIG. 1A and manipulated to form a U-shape, said shape held in place by the fastening means 5, such as tie strips 12 as illustrated.

Figure 4:
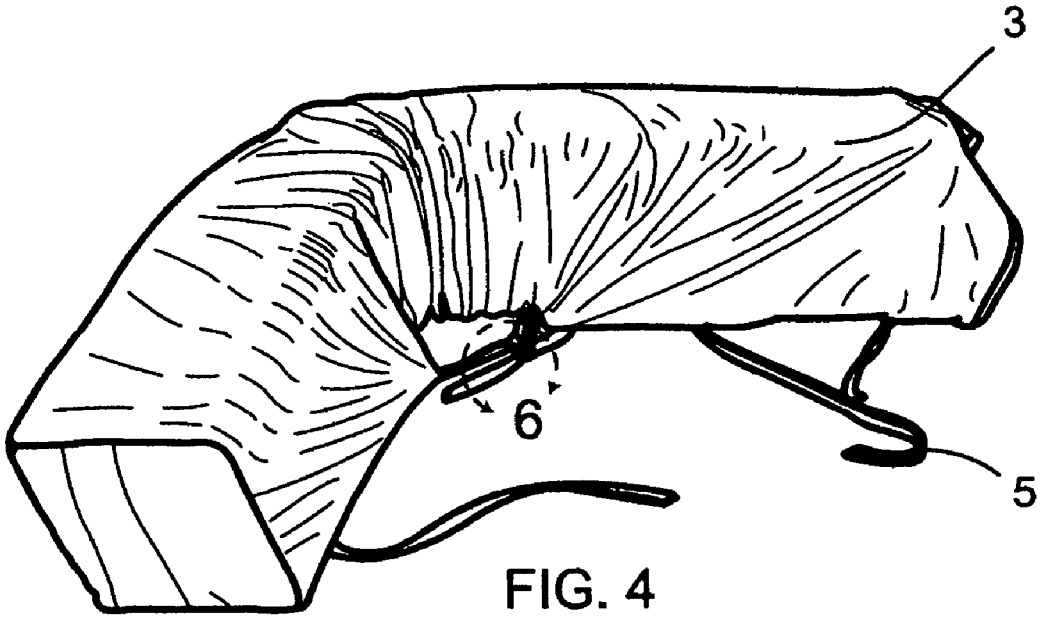
FIG. 4 is a perspective view of the embodiment of the invention having a square cross shape cushion manipulated so as to form an L-shape, to illustrate that the invention may be manipulated to form a variety of different shapes.

FIG. 4 shows a perspective view of the embodiment of the invention having foam 10 with the square cross-section cushion illustrated in FIG. 1B and manipulated to form a U-shape, said shape held in place by a fastening means 5, such as tie strips 12 as illustrated.

Figure 5:
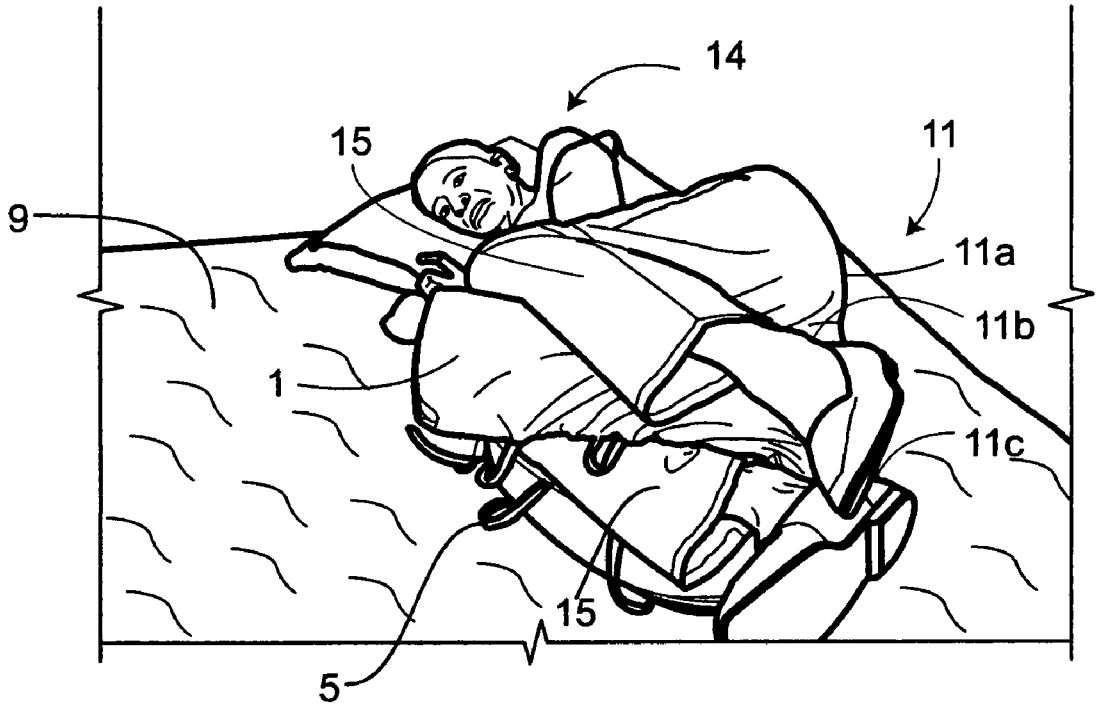
FIG. 5 is a side elevation view of a patient laying on the device, and a bed sore area of the patient elevated above and not touching the bed surface.

FIG. 5 shows a side elevation view of a patient 3, utilizing an embodiment of the present invention. The wound elevation protection and prevention device 1 is placed between a patient 3 and a surface 9 in order to elevate a portion 11*b* of the patient 3 above the surface 9.

The wound elevation protection and prevention device 1 is manipulated as in FIG. 5, to rest between the patients lower extremities 11 thereby elevating at least three areas of "bony prominence", the coccyx 11*a* and both ankle and heel regions 11*b* and 11*c*, above the surface 9.

The device may be adjusted and manipulated to take varying shapes by using the fastening means 5, such as tie strips 12, Velcro 13 or other fastening means commonly known in the art.

Figure 6A:
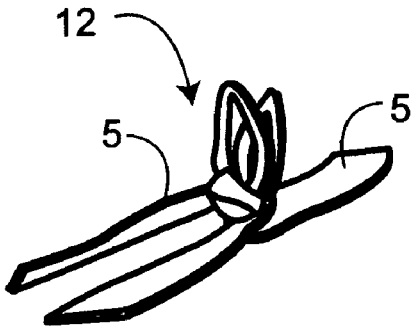
FIG. 6A is a close-up of a fastening means denoting a tie knot; generally taken along lines 6-6 of FIG. 4.
Figure 6B:
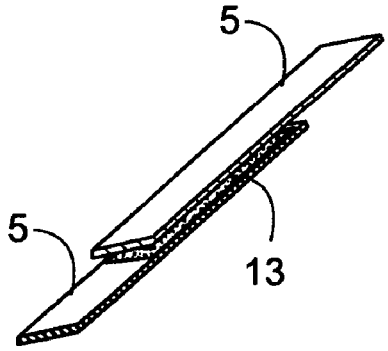
FIG. 6B is a close-up of an alternate fastening means denoting Velcro strips.

FIG. 6A shows the tie strips 12 held together in a tie knot. FIG. 6B shows Velcro strips 13 or other hook-and-loop type fasteners, which may also be used as herein described to accommodate the size, location and shape of the wound in order to provide the required support.

The viscoelastic polyurethane foam 10 has a density of between 2 to 6 pounds, preferably between 4 and 5 pounds, and is ideally 4.30 pounds. Its cross section may be of varying shapes and sizes. For example, it may have a circular cross section as shown in FIG. 1A or a square cross section as shown in FIG. 1B, as well as other suitable shapes and sizes not herein indicated. The viscoleastic polyurethane foam 10 provides the support required to elevate the body, such that the wound is not in direct contact with a surface 9, such as a bedding.

An alternate filling material 4 such as buckwheat hulls, whole buckwheat seeds, millet hulls or any combination thereof may be used as shown in FIGS. 2A' and 2B'. The said alternate filling material may vary in cross shape and size and may be somewhat more malleable than the viscoelastic polyurethane foam 10.

The wound elevation protection and prevention device 1 as described herein is designed to elevate a wound or an area prone to developing a wound, such as the coccyx 11*a* and ankle and heel regions 11*b*, 11*c* above a surface 9, such as a bedding, such that the surface 9 and the wound 11*a*, 11*b*, 11*c* are not in direct contact.

As a result of increased air flow and blood circulation, the wound heals faster and ideally no pressure sores develop. The ability to tailor the device to suit individual needs allows the nurse, patient or caregiver to select the shape which fits best the case.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

CONCLUSION

The terms wound, blemish, decubitus ulcer, pressure ulcer, pressure sore, bed sore or surgical site are used interchangeably in this application. The term "wound" as used in this application is intended to denote injuries, lesions, gashes, sores, abrasions and wounds in general.

While various embodiments of the present invention have been described above, it should be understood that they have been presented by way of example only, and not limitation. It will be understood by those skilled in the art that various changes in form and details may be made therein without departing from the spirit and scope of the invention. Thus, the breadth and scope of the invention should not be limited by any of the above-described exemplary embodiments.

What is claimed is:

1. A unitary elongated support device for supporting a body part with a bony prominence which is susceptible to developing a sore or wound comprising:

a memory foam fill material having a rolled shape which is generally cylindrical and is formed by rolling along its longitudinal axis;

a flexible cover for holding and maintaining the cylindrical shape having a closable opening disposed therein for inserting the memory foam fill material within; and releasable fastening means comprising tie strips positioned on the flexible cover for securing and positioning the unitary elongated support device for supporting around a bony prominence in said body part;

whereby said elongated support device is pliable and easy to manipulate to form a U-shape to provide support around a bony prominence so that the bony prominence is elevated above when supported in order to avoid any sore or wound from developing as a consequence of constantly resting on a surface.

2. The support device according to claim 1, wherein the fill material comprises a viscoelastic polyurethane foam having a density between 4.0 and 8.0 pounds per cubic feet, preferably about 4.33 Pounds per cubic feet.

3. The support device according to claim 1, wherein the rolled cylindrical support shape is formed having a ratio of diameter to length of about 0.1 to 0.2.

4. The support device according to claim 1, wherein the flexible cover maintains substantially continuous contact with the unitary elongated shape having a substantially uniform circular cross-section.

5. An unitary elongated support device for supporting a body part with a bony prominence which is susceptible to developing a sore or wound comprising:

the elongated support device having a generally square cross-section is formed of a memory foam fill material;

a flexible cover for holding and maintaining the generally square shape having a closable opening disposed therein for inserting the memory foam fill material within; and releasable fastening means comprising tie strips positioned on the flexible cover for securing and positioning the unitary elongated support device for supporting around a bony prominence in said body part;

whereby said elongated support device is pliable and easy to manipulate to form a U-shape to provide support around a bony prominence so that the bony prominence is elevated above when supported in order to avoid any sore or wound from developing as a consequence of constantly resting on a surface.

6. The support device according to claim 5, wherein the fill material comprises a viscoelastic polyurethane foam having a density between 4.0 and 8.0 pounds per cubic feet, preferably about 4.33 pounds per cubic feet.

7. The support device according to claim 5, wherein the generally square cross-section of the elongated support device is formed having a ratio of about 0.1 to 0.2 between a side of a generally square cross-section and a length of the elongated support device.

8. The support device according to claim 5, wherein the flexible cover maintains substantially continuous contact with the unitary elongated shape having a generally square cross-section.

* * * * *